US005576600A

United States Patent [19]

McCrary et al.

[11] Patent Number: 5,576,600

[45] Date of Patent: Nov. 19, 1996

[54] BROAD HIGH CURRENT ION SOURCE

[75] Inventors: Leon E. McCrary, Scituate, Mass.; Ronald R. Willey, Melbourne, Fla.

[73] Assignee: DynaTenn, Inc., Weymouth, Mass.

[21] Appl. No.: 399,448

[22] Filed: Mar. 7, 1995

Related U.S. Application Data

[63] Continuation-in-part of Ser. No. 362,717, Dec. 23, 1994.

[51] Int. Cl.[6] ..... H01J 7/24

[52] U.S. Cl. ..... 315/111.81; 315/111.41; 315/111.61; 313/231.31; 313/359.1; 250/427; 250/423 R

[58] Field of Search ..... 315/111.81, 111.91, 315/111.71, 111.61, 111.41; 313/231.31, 359.1, 360.1, 362.1; 250/423 R, 423 F, 427

[56] References Cited

U.S. PATENT DOCUMENTS

| | | | |
|---|---|---|---|
| 4,166,018 | 8/1979 | Chapin | 204/192 |
| 4,303,865 | 12/1981 | Swingler | 250/423 |
| 4,361,472 | 11/1982 | Morrison, Jr. | 204/192 |
| 4,434,038 | 2/1984 | Morrison, Jr. | 204/192 |
| 4,481,062 | 11/1984 | Kaufman et al. | 156/345 |
| 4,507,588 | 3/1985 | Asmussen et al. | 315/39 |
| 4,548,033 | 10/1985 | Cann | 315/111.61 X |
| 4,672,615 | 6/1987 | Kelly et al. | 372/2 |
| 4,710,283 | 12/1987 | Singh et al. | 204/298 |
| 4,749,912 | 6/1988 | Hara et al. | 315/111.81 |
| 4,760,262 | 7/1988 | Sampayan et al. | 315/111.81 X |
| 4,767,931 | 8/1988 | Sato et al. | 315/111.81 X |
| 4,785,220 | 11/1988 | Brown et al. | 315/111.81 |
| 4,862,032 | 8/1989 | Kaufman et al. | 313/359.1 |

FOREIGN PATENT DOCUMENTS 0197668 10/1986 European Pat. Off. .

*Primary Examiner*—Robert Pascal
*Assistant Examiner*—Haissa Philogene
*Attorney, Agent, or Firm*—Lahive & Cockfield

[57] ABSTRACT

An ion source has a peripheral wall, a back face and a front face which together define a plasma chamber extending along an axis. In one embodiment, a central aperture emits ions from plasma formed in a generally annular containment band about the aperture, and a plurality of magnets define magnetic field lines extending into the band, so that electrons traveling from the cathode are trapped in the band and highly effective ionization is achieved, producing high beam currents. An anode at the back of the source expels ions from the central region. In another or further embodiment, the plasma chamber has an anode plate which extends across the back of the source, and provides a broad expulsion field for expelling and preferably shaping a high current in ion output beam. A fluid inlet introduces an ionizable fluid in the peripheral region to interact with the trapped electrons, generating plasma with high efficiency. In a preferred embodiment, the anode plate channels the incoming fluid to the peripheral band directing it into the electron region to reach the aperture. In various constructions, the magnets are arranged in pairs to provide opposite poles adjacent each other extending entirely around the annulus. The north-south poles of the pairs of magnets may be arrayed along the inner face of the front plate, the inside face of the peripheral wall, or may be arrayed on both front and side surfaces to define magnetic lines extending diagonally across the peripheral band. Preferably, the magnets are mounted on a ring of magnetic material, and the ring is cooled so that it positions and orients the magnetic field lines while cooling the magnets by direct thermal contact. A cover plate of electrically conductive but non-magnetic material shields all of the magnets and defines a smooth continuous inner wall of the plasma chamber. Robust materials may be used for other components, such as steel or iron for the various plates, anode, and walls. In a preferred embodiment the anode is cooled by fluid circulating through internal passages thereof.

20 Claims, 6 Drawing Sheets

BROAD HIGH CURRENT ION SOURCE

REFERENCE TO RELATED APPLICATION

This is a continuation in part of U.S. patent application Ser. No. 08/362,717 entitled Ion Beam Source and filed on Dec. 23, 1994 by the present inventors.

BACKGROUND

Compact ion beam installations find broad utility in a number of manufacturing and processing applications, such as substrate cleaning by ion beam sputtering, ion-assisted deposition and etching, and various forms of surface treatment and material modification. Common constructions of ion sources for these purposes include somewhat modular ion "guns", in which a canister defines a confinement area into which an ionizable fluid such as oxygen, nitrogen or argon gas is introduced, and in which various electrodes and magnets operate to ionize and extract, and generally also accelerate, ionized particles from one end of the gun as a directed ion beam. Generally, the plasma is ionized within the chamber formed by the canister, by cathode and anode electrodes maintained at a potential difference typically of several tens of volts. A larger potential difference is usually applied to extract the ionized particles.

In one class of ion sources of this type, generally referred to as Kaufmann sources, extraction results from using two or more conductive plates having a multiplicity of small apertures in each plate, with the plates covering one wall of the plasma chamber. An inner plate serves as a conductive surface proximate to which a glowing sheet-like region of highly ionized plasma is formed. The second electrode is parallel to this apertured plate and is spaced several millimeters from it, and is maintained at a potential difference of several hundred or more volts, with apertures aligned with those of the first plate. The potential difference forms a strong electrostatic accelerating field which draws ions from the glow region within the chamber and directs them outwardly along an axis. The parallel apertured plates form a more or less homogenous electrostatic accelerating field, so that the beam extracted through each aligned pair of apertures is fairly well collimated along the projection axis.

Such ion sources are generally used within a vacuum chamber and the beam they form is directed at a workpiece or sputtering target for effecting the desired processing. The ions effectively retain their directional energy and are able to reach the target only under conditions of vacuum, e.g., $10^{-3}$ Torr or higher vacuum. In these circumstances, the volume of gas supplied to the plasma chamber to form the ions can have a substantial effect on the level of vacuum within the processing chamber. This gas is to be ionized with a high degree of efficiency, so as not to pressurize the chamber and defeat operation of the ion beam. In the foregoing Kaufmann-type constructions, the inner electrode serves, in part, to contain the low pressure plasma within the plasma chamber so that only ions of one polarity are actively drawn out by the acceleration field and leave the chamber. Other elements of these constructions, used to enhance the efficiency of ionization within the plasma chamber, include the provision of one or more magnets, and generally a cathode source for providing electrons to initiate the ionization process. Electrons emitted by the cathode follow cyclotron paths along the magnetic lines of force and are thus constrained to reside within a small area for a relatively long time. This enhances the likelihood of electrons colliding with gas molecules and forming the plasma from which ions are extracted. Once ionization is initiated, ionic conduction between the cathode and the anode can increase the number of ions available. Such current flow can also produce heat and erosion of electrodes.

Despite the added efficiencies of plasma generation achieved by physical confinement of the plasma and magnetic confinement of the electrons, the total ion current, or ion flux delivered by such a source remains limited due to the low pressure of gas necessarily employed in this setting. Furthermore, while larger currents can be achieved by scaling up multi-grid Kaufmann sources, thereby providing larger areas in which ionization occurs and a greater effective area through which ions are extracted from the plasma chamber, the nature of the processes involved, namely the provision of ionization current and the flowing of material into a plasma process, remains the subject of substantial design experimentation. Problems still arise, such as burning, unexpected creation of hot spots, erosion of components of the source, and instabilities in the beam-forming characteristics.

For processes wherein beam purity or beam collimation are not serious constraints, the design of an ion source may be relaxed somewhat, and greater absolute power densities achieved by optimizing ion-forming rather than beam forming parameters. Thus, ion treatment devices are known which produce a large flux of ionized gas, and this plasma is allowed to extend outwardly, past the front face of the plasma chamber, unconstrained by focusing or collimating grid assemblies. A suitable potential applied to the target or to a highly permeable front screen may accelerate this ion flux toward the target or workpiece. Such devices can operate with a single screen in front, preferably maintained at cathodic potential, which serves to confine electrons and yet provides a permeable opening that draws out positive ions. One such construction is shown in U.S. Pat. No. 4,710,283. In these simple constructions and in the more common Kaufmann type constructions, the front electrodes are subject to sputtering and wear. The cathodes, if separate elements, are also subject to wear. However, at least in single screen constructions, the replacement of the front electrode element is relatively straightforward, and questions of alignment and the like do not arise. The construction is thus highly suitable for bulk manufacturing processes such as etching and surface densification wherein slight sputter contamination of the beam is tolerated and beam collimation is not required.

These ion sources, less constrained by considerations of beam purity, beam collimation and beam uniformity, can produce ions at relatively high current levels. However, the presence of uncontrolled processes and hot spots remain problematic especially at high power, and there remains a need for ion source constructions which dependably generate a continuous high current plasma and emit a powerful stream of ions as a treatment beam. It is also desirable to provide a simple and rugged construction which efficiently produces ionized plasma and projects it as a beam.

SUMMARY

The present invention attains many of the foregoing objectives with an ion source having a peripheral wall, a back face and a front face which together define a plasma chamber extending along an axis. The chamber forms a broad, flat canister, and the front face contains a central aperture of lesser diameter than the canister for extraction of plasma. The front face and the peripheral wall define a generally annular containment band about the aperture, and a plurality of magnets, having poles facing around the annulus, defines magnetic field lines extending convexly into the containment band. A cathode is situated at the front of the source such that electrons emitted from the cathode are trapped in the band along magnetic field lines. A fluid inlet introduces an ionizable fluid in a peripheral region of the chamber to interact with the trapped electrons, generating plasma with high efficiency. An anode plate extends laterally at the back of the source and repels positive ions from the plasma out the central aperture. In a preferred embodiment, the anode channels the incoming fluid to a periphery of the chamber so that it diffuses through the region of trapped electrons and ionizes before reaching the aperture.

In various constructions, the magnets are arranged in pairs to provide opposite poles adjacent each other in an array extending entirely around the annulus. The north-south poles of the pairs of magnets can be arrayed along the inner face of the front plate, along the inside face of the peripheral wall, or on both front and side surfaces to define magnetic lines extending between the front face and the periphery. The magnetic lines create a dense electron pool directly across the diffusion path between the fluid inlet and the central aperture. Preferably, a cover plate of electrically conductive but non-magnetic material covers the magnets and defines a smooth continuous inner wall of the plasma chamber. This isolates the magnets from the potentially hot plasma processes and from the electrons, while providing an equipotential surface that enhances spatial definition of the glow region at the field lines. Robust materials may be used for other components, such as steel or iron for the various plates, anode, and walls. Preferred magnet constructions employ portions of the underlying plates as shunts to position field lines between the poles for maximum effect.

In one preferred embodiment, the anode is a relatively thick disk substantially coextensive with the back of the chamber and lying entirely separate from the containment band. Internal fluid cooling conduits may optionally be provided to cool the anode and/or portions of the chamber face, magnet support or walls. The anode itself can form part of a gas introduction system, with gas passages extending radially therethrough to a plurality of discrete points about its circumference.

BRIEF DESCRIPTION OF THE DRAWINGS

These and other features of the invention will be understood from the description below, together with the drawings wherein.

DESCRIPTION OF ILLUSTRATED EMBODIMENTS

Figure 1:
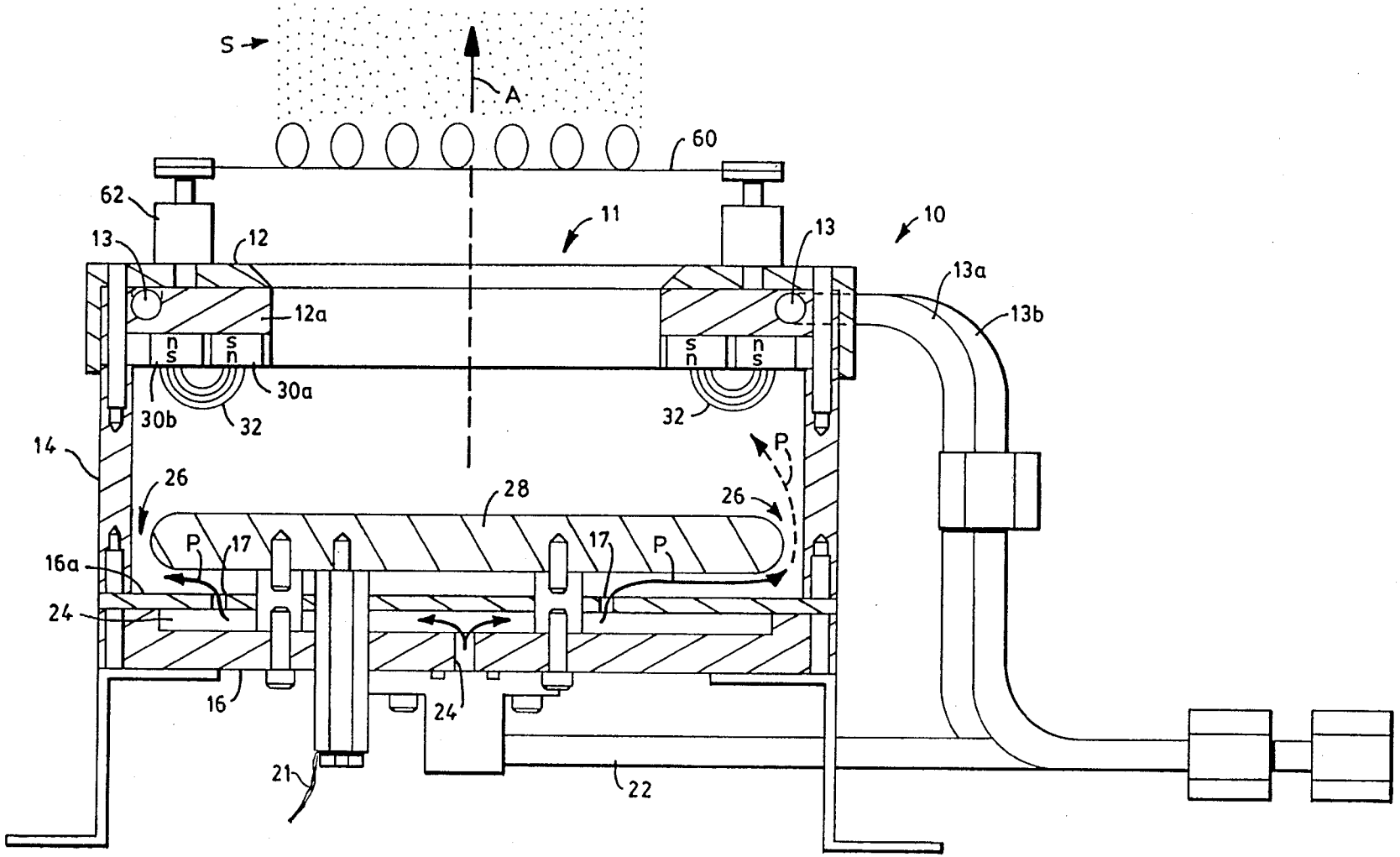
FIG. 1 is a cross-sectional view, along a plane aligned with the axis of the ion source, of one embodiment of an ion source in accordance with the present invention.

FIG. 1 shows an ion source 10 in accordance with the present invention in a plane section taken parallel to an axis A along which the source projects ions. In an illustrative embodiment, the ion source and major components thereof possess radial symmetry about a center so that the source as a whole appears cylindrical or canister shaped. In other embodiments, the overall shape may be more or less oval, or elongated to provide a relatively wide strip beam output. In general, however, whatever the overall shape, the contours of the device, viewed in a plane perpendicular to the axis A, preferably are rounded. This avoids the creation of corners which might cause hot spots or areas in which debris or sputter contamination could accumulate or which might cause high field strengths or otherwise lead to detrimental conditions.

As shown in FIG. 1, the ion source 10 includes a plasma containment chamber defined by enclosing walls including a front wall 12, a peripheral wall 14 and a back wall 16. A gas inlet 22 delivers an ionizable gas such as argon, oxygen, nitrogen or hydrogen to the back of the chamber, and the gas travels along a passage 24 to enter the chamber at a peripherally-located annular region 26 adjacent the rear of the chamber. At the front of the source, a cathode 60 or other source of electrons is provided to ionize the gas, and electrons it emits travel toward an anode 28 at the back of the chamber. In the illustrated embodiment, the anode 28 spans a central opening 11 in the front, and extends beyond the edges of the opening and is substantially coextensive with, the back wall 16 closing the chamber. In this embodiment, arrayed along the inside of the front wall 12, on its surface facing inwardly toward the chamber, are a plurality of permanent magnets 30*a*, 30*b* arranged in sets of at least two magnets closely spaced to each other. One magnet 30*a* of each set is located radially inward, on an inner face of front wall 12, relative to another magnet 30*b* of that set. The inner magnets 30*a*—30*a* have poles facing inwardly toward the chamber interior which are of opposite polarity relative to the outer magnets 30*b*—30*b*. Each magnet 30*a* is thus associated with at least one corresponding magnet 30*b* of opposite polarity to create magnetic field lines 32 spanning between the pole faces of the magnets. The field lines 32 extend in the chamber in a broad continuous path bowing convexly into the annular band or region surrounding the central opening 11 of the front face 12, contiguous with the peripheral annulus 26 where the gas is introduced. Since the pairs are arranged in continuous succession about the entire circumference, these field lines thus substantially cover the inside front wall.

With reference to FIG. 1, one embodiment of the illustrated source 10 has circular front and back walls 12 and 16, respectively, located parallel to each other and spaced apart along the axis A. A circular opening 11 apertures the front wall 12, concentric with the axis A. The peripheral wall 14 is cylindrical and concentric with the axis A.

The anode 28 in this embodiment is a circular disk concentric with the axis A and having a front surface, i.e. the surface facing the front wall 12. The anode is disposed parallel to and between the walls 12 and 16, within the chamber, and is mounted, for example as disclosed below with reference to FIG. 2, electrically isolated from other elements of the chamber, to maintain an electrical potential difference from the chamber walls..

The radial span of the anode 28 extends close to the inner face of the peripheral wall 14, to define a radially extending annular gap, between the periphery of the anode and the peripheral wall, through which gas from the inlet 22 and passage 24 enters the annular region 26. The inlet gas is thus directed at the magnetic lines 32 about the periphery, and the entry region is a maximum radial distance from the center of the chamber.

Also in this embodiment, the passage 24, which distributes gas from the inlet 22 toward the annular region 26, is essentially a disk-shaped gas distribution manifold bounded on a front side by the back surface of a gas distribution plate 16*a*, and on its back side by the back wall 16.

A plurality of apertures 17 are formed in plate 16*a* near the edge of anode 28, and gas exiting the apertures is blocked by the solid anode 28 so that it travels to periphery. The gas distribution plate 16*a*, in common with walls 14 and 16, is grounded. Furthermore, the anode back face is located within the cathode dark space of the gas distribution plate so no plasma is formed at the anode backside and all plasma processes are effectively constrained to occur in the region above the anode.

At the front of the chamber a magnet support plate 12*a* holds the magnets 30*a*, 30*b* so that they line the inside surface of the plasma chamber.

Figure 1A:
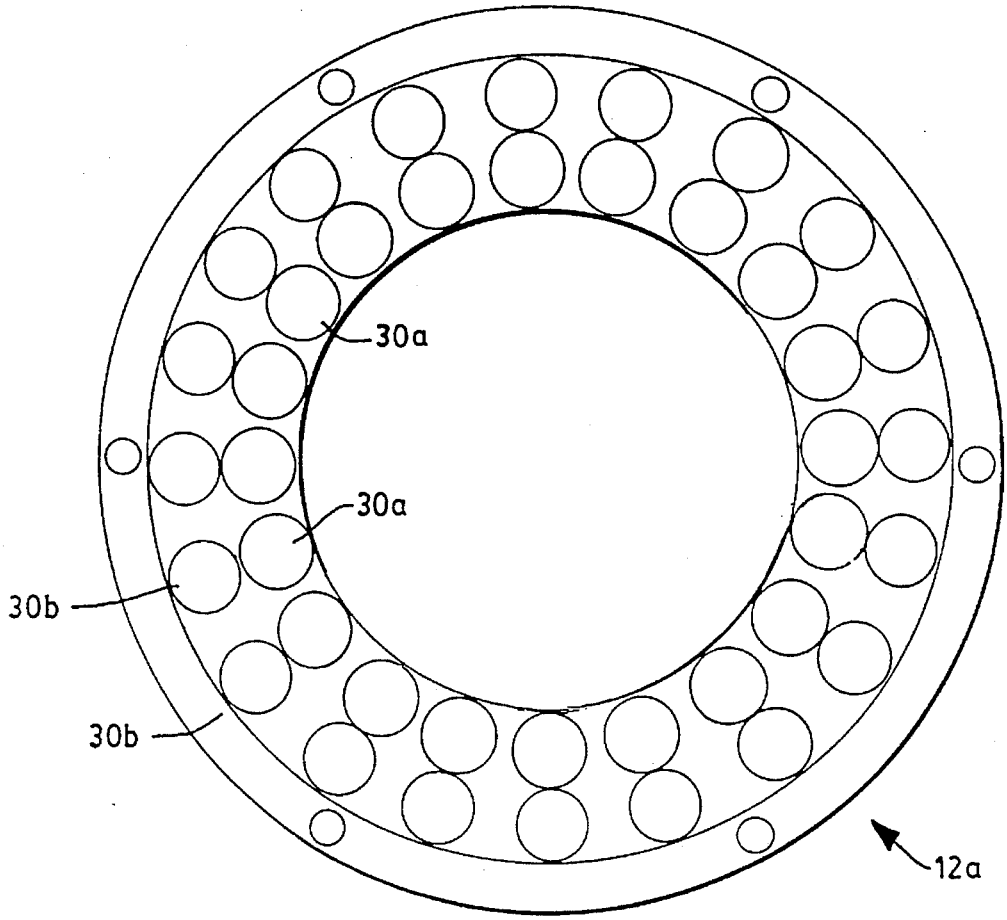
FIGS. 1A and 1B are respectively, plan and fragmentary cross-sectional views of a magnet support plate of the embodiment of FIG. 1.
Figure 1B:
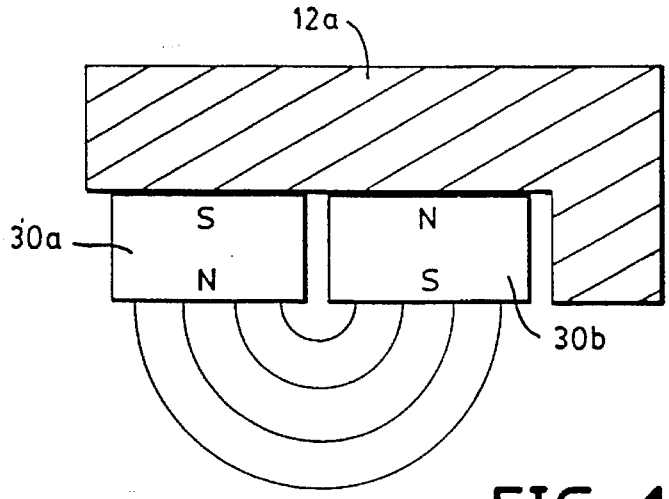

As shown in FIGS. 1A, 1B, the magnet support plate 12*a* is a generally disc-shaped member with a large central aperture and having a flat recess or band formed in a broad circumferential region for supporting magnets 30*a*, 30*b* in several rows contiguous with each other. The plate 12*a* is preferably made of soft iron, and operates as a direct magnetic shunt across each pair of adjacent magnets, which may be small button-, ring- or block-type permanent magnets, so that pairs of the magnets develop high field lines between their exposed pole faces which extend into the chamber. The illustrated plate 12*a* is dimensioned to support two courses of magnets in a plane next to each other such that they substantially cover the entire area surrounding the central opening. As further shown in FIG. 1, an internal passage 13 is provided in the magnet support plate 12*a* for circulation of a cooling fluid therein. Inlet and outlet coolant lines 13*a*, 13*b* provide a flow of coolant, e.g., water, to maintain plate 12*a* at a temperature below about 100° C. The support plate thus serves as a contact thermal shunt to maintain the magnets as a temperature below their Curie temperature, as well as a magnetic shunt between oppositely-poled adjacent magnets 30*a*, 30*b*. The magnets, for example, may be small cylindrical button magnets one-half inch in diameter and one-fifth of an inch thick, preferably of a neodymium/iron/boron composition to provide high field strength. If the plate is not provided with internal heat exchange cooling passages, then samarium cobalt magnets may be substituted to operate at somewhat higher temperatures, albeit with a slight reduction in field strength.

As shown in FIG. 1B, the plate 12*a* positions magnets 30*a*, 30*b* so that strong magnetic field lines 32 bow into the region around the central aperture, filling an annular band at the periphery of the plasma chamber.

Continuing now with a description of FIG. 1, the anode plate 28 is maintained at a relatively high positive potential, approximately 50–500 volts DC with respect to the cathode, chamber face and side wall. With this arrangement, electrons emitted by the cathode travel or are drawn inward towards the anode and are trapped by the lines of force 32 in the annular containment band around aperture 11 and here they undergo cyclotron motion along the field lines 32. Thus, the average dwell time of electrons in this region is long and the electron density is also high. The ionizable gas introduced through the inlet 22 along passage 24 follows a path indicated generally by P traveling through the containment band to reach the aperture 11. When the gas is ionized by collision with electrons, it then engages in various interactions with other ions or molecules, and with the surrounding electrodes. In particular, negatively charged ions will be relatively uninfluenced by the magnetic field and may be drawn toward the anode, while positively charged ions in the central region will be repulsed by the relatively high positive potential of the anode and ejected through the central aperture. These ions may also be drawn outwardly toward a cathode or toward a negatively biased or grounded target outside the chamber (not shown) as a plasma or ionic stream S through the aperture 11. In general, the gas introduction rate is kept high, and a rather dense unconstrained plasma extends outwardly through the aperture 11 due to the high ionization current and the absence of effective screening elements discussed further below, and the presence of the like-charge anode.

FIG. 1 represents a prototype embodiment, and is drawn roughly full scale, to show a plasma chamber of approximately 15 centimeters diameter, with major structural elements of the chamber such as the peripheral wall 14, back plate 16 and anode 28 formed of relatively thick plate elements having a thickness of five to fifteen, and preferably about twelve millimeters. Anode 28 and back wall 16 are preferably formed of materials such as stainless steel, and the front face 12 and peripheral wall 14 may be formed of materials such as stainless steel although the magnet plate 12*a*, which may constitute all or a portion of the front face 12, is formed of a soft magnetic material. More generally, in certain instances, as discussed further below, particular portions of the chamber are specifically selected to be non-magnetic stainless steel materials, and certain other portions are specifically magnetic where shunting of different elements is required. While not illustrated in FIG. 1, a fluid cooling jacket with inlet and outlet pipes that forms or encloses a ring or cup-like structure at the back portion of the plasma chamber of source 10, may also be provided to form a heat sink for the plasma chamber as a whole.

The front-to-back distance along axis "A" between the magnets 30 and the anode 28 is approximately three centimeters, so that the active region of the plasma chamber has a width-to-depth aspect ratio of about five to one. Furthermore, the annular band surrounding the central aperture 11 occupies 50–70% of the cross-sectional area of the source, so that the flow of ionizable gas resides in or at the field lines 32 for an effective period of time. Aperture 11 is, however, made as large a diameter as practicable to achieve a high output over a broad area. The overall arrangement compartmentalizes the various processes of the device, with plasma firing or initiation occurring in the peripheral band where the magnets are protected and effectively cooled, while the ejection of a high current ion beam occurs in the central region.

Figure 2:
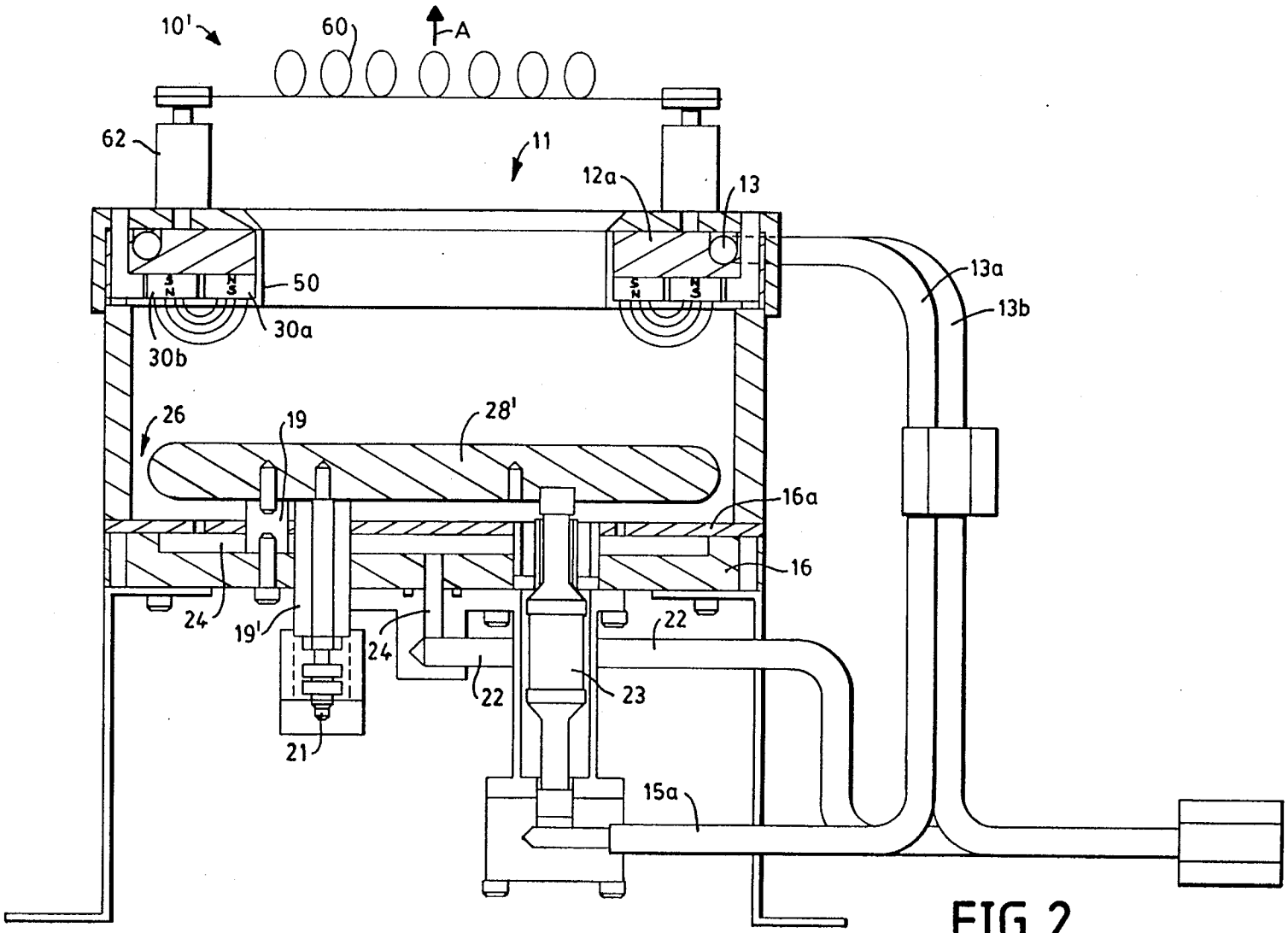
FIG. 2 illustrates another embodiment of the invention.

FIG. 2 shows another embodiment of an ion source 10' in accordance with the present invention, illustrating further or alternative implementations of the elements described above. In this embodiment, a gas introduction manifold is defined between the back face 16 and a baffle plate 16*a*, which mounts over a recess 24' in the back face 16. Recess 24' is connected to a gas inlet 22 and communicates with a radially symmetric array of holes 17 in the plate 16*a* to provide the inlet gas uniformly about the chamber below the anode 28'. Anode 28', like anode 28 of the first embodiment, is a broad flat plate spanning the area below the central aperture 11, and over the holes 17 so that the anode is, to a small extent, cooled by the incoming gas and so that the anode also channels the gas outward to a peripheral band 26. The anode is supported by insulating posts 19, and energized by an electrical conductor 21 which feeds through the chamber back wall 16 at an insulated collar 19' as illustrated. In the illustrated design, the anode is maintained at 50–500 volts above the remainder of the housing, and powered at approximately 5–10 amperes. With the internal heat exchange coolant passages for the anodes described further below power levels several times as high are attainable.

In this embodiment, the coolant inlet and outlet passages 13*a*, 13*b* which cool the magnet support plate 12*a* are connected to a fluid lead-in line 15*a* and a lead-out line, of which the forward line 15*a* is visible in the drawing, which connect by insulated fluid feed through 23 to the anode 28'. Suitable passages in anode 28' circulate the coolant, which may be water, or an electrically non-conducting medium of suitable heat transfer characteristics.

As in the first described embodiment, a plurality of magnets 30*a*, 30*b* are arrayed in pairs about the peripheral band. This FIGURE further illustrates a contoured cover plate 50 formed of sheet metal which covers the magnet assembly and provides a smooth conductive wall of the chamber. Cover plate 50 is preferably made of a non-magnetic stainless steel, and protects the temperature-sensitive magnets from the hot plasma, while allowing the field lines 32 to pass therethrough.

Figure 3:
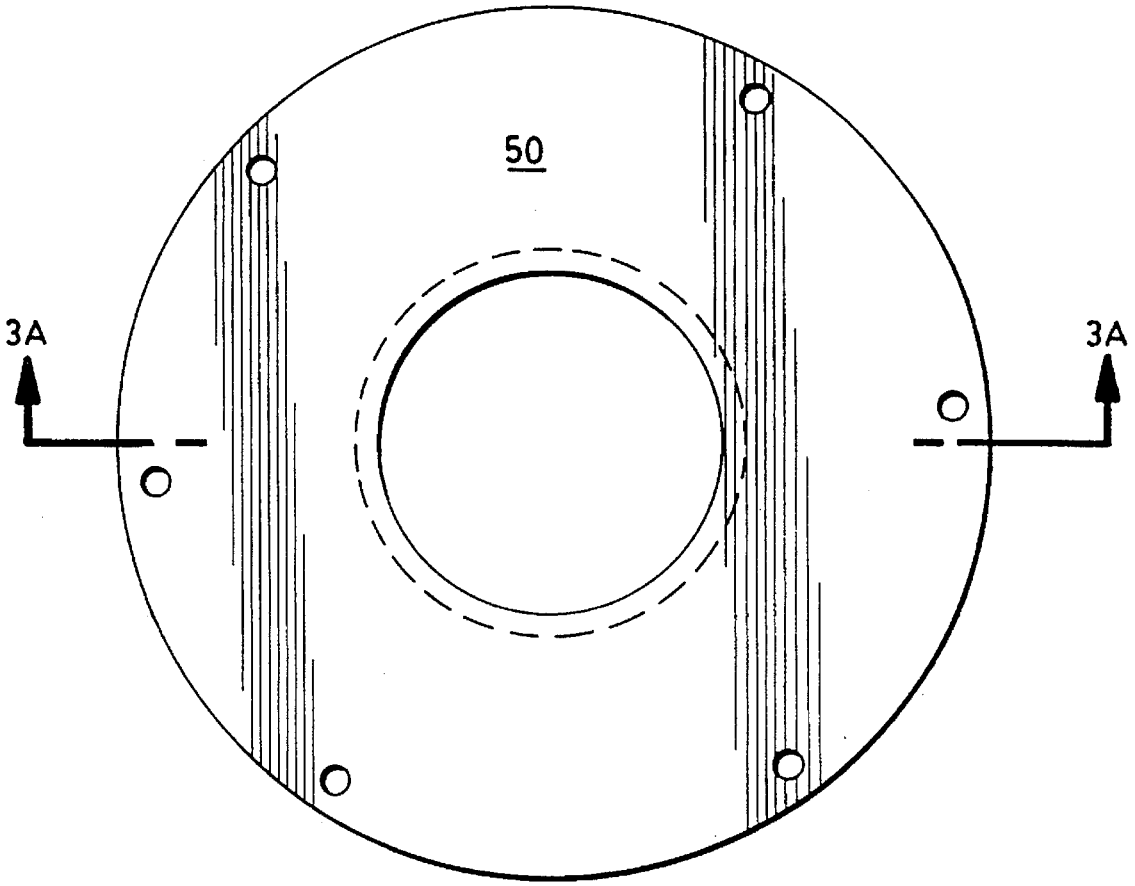
FIGS. 3 and 3A show a magnet cover plate for the embodiments of FIGS. 1 and 2.
Figure 3A:
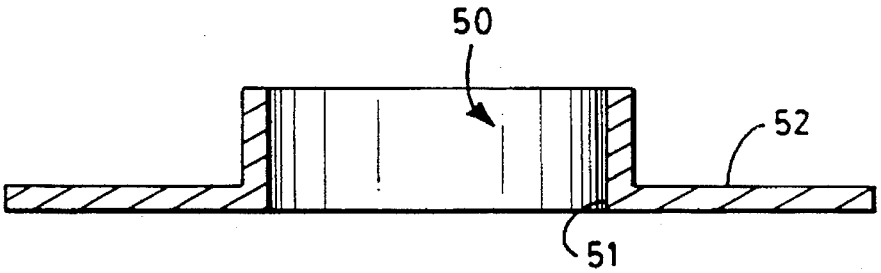

As shown in FIGS. 3 and 3A, the cover plate 50 is a thin sheet metal element, preferably made of a relatively heat and corrosion resistant material such as stainless steel, which is both electrically conductive and non-magnetic. Plate 50 has a rounded corner 51 at the edge of the aperture 11, which allows smooth gas/plasma flow to the central region, and has a flat face 52 which closely fits over the pole faces of the magnets 30*a*, 30*b*, so that the magnetic lines penetrate as far as possible into the plasma chamber of which the plate 50 forms a boundary. The inner (plasma) side of plate 50 may be polished to avoid surface irregularities that might serve as hot foci for plasma arcing, or which might accumulate debris or accretions.

Returning now to FIG. 2, at the front of the ion source 10', a cathode 60 extends across the opening 11 and is supported by insulated stand-offs 62. Cathode 60 may be formed of tungsten wire, and is operated as a hot filament to provide electrons to start the plasma ionization process as described above. In a prototype embodiment, cathode 60 is energized with twenty to fifty volts AC at eight to twenty-five amperes. The illustrated cathode is a simple linear filament rather than a space-filling screen or mesh, and does not substantially block the opening 11. In operation, once a stream of positive ions is initiated, the cathode also serves to bathe the exiting ion stream in electrons, providing partial or complete charge neutralization. In its steady state operation, the high power provided between the anode and the plasma chamber maintains a hot plasma process from which electrons are continuously captured by the magnetic field lines 32. Thus, electrons from the cathode are not required in great amounts to maintain the plasma, and the cathode power may be selectively controlled to vary the flux of electrons provided into the stream of emitted ions. This varies the relative amounts of positive ions and neutralized gas in the output, and controls the total charge build-up that occurs on the workpiece, in accordance with the particular process line application. For example, when used for ion beam densification of a titanium oxide coating, the energy (eV) of the delivered charge must be maintained below a certain threshold to prevent molecular damage and stochiometric problems by the dielectric layer. A higher voltage may be tolerated in an $SiO_2$ coating, allowing cathode 60 to be operated at lower power.

It will be seen that the foregoing constructions achieve a high-flow, high power ion source wherein a thin plasma chamber is set up to force gas introduced at a peripheral region to ionize in a trapped electron band about the chamber periphery, and flow is maintained by expelling positive ions which reach the center. Negative ions will be partly confined by the intense electron trapping regions, and will also give up their electrons to the anode or housing. This latter process results in high current flow and heat generation in the plasma chamber. To some extent this power is accommodated, if not dissipated by the broad area of the anode and the use of thick plates for chamber walls and housing. Preferably, however, as briefly indicated above, water or other heat exchange cooling passages are provided in the anode as well as in the magnet support plate.

The cooling in these two regions may be effected at two different rates. The magnets, preferably covered by magnet plate 50, are effectively insulated from the hot plasma environment, and they receive heat principally through the plate 50 and by conduction, through magnet plate 12*a*, from the thick side wall 14. The cooling passages 13 channel a flow of water to cool the plate 12*a* to act as a thermal barrier to the hot side wall, and to provide contact cooling for the magnets resting thereon. This cooling need only be sufficient to maintain the magnets at a temperature below their Curie temperature.

The anode, on the other hand must dissipate hundreds of watts of power due to the ionic and electron current flow occurring continuously at the anode. This process of charge transfer with a hot plasma can lead to high rates of heating. The cooling passages in the anode, if provided, are to prevent the extreme heating.

In each case, the passages are preferably implemented by forming the body of the anode or support plate in two parts, with one or more grooves in the surface of at least one part that constitutes the coolant passage once the halves are joined together face-to-face. Circumferential grooves or ridges readily provide broad and symmetric cooling passages that resist thermal warping and leakage.

As noted above, the flow of ionizable gas follows a generally radial flow from the periphery to the center of the plasma chamber, during which it crosses a patchwork of magnetic field lines in the peripheral band behind the front face that define regions of high electron density. In accordance with other embodiments of the invention, the magnetic field regions are spaced in different orientations within the peripheral regions. Several alternative embodiments are shown in cross-sectional detail drawings in FIGS. 5A, 5B and 5C.

Figure 5A:
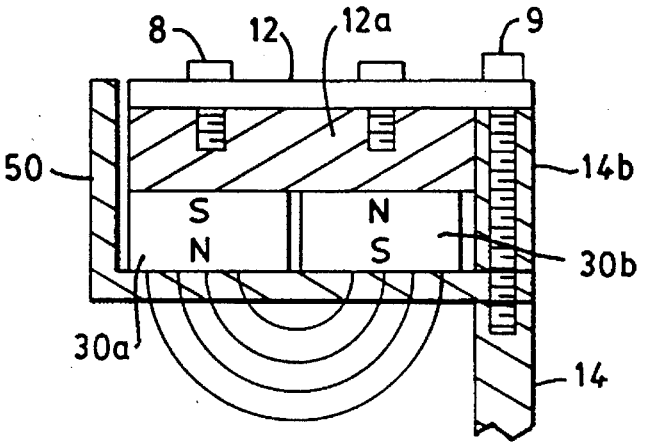
FIGS. 5A, 5B and 5C illustrate different magnet positions in different embodiments of an ion source according to the invention.

FIG. 5A illustrates the peripheral arrangement of magnets 30*a*, 30*b* essentially as mounted in the embodiment of FIG. 1. A soft iron shunt 12*a* in the form of a thick annular plate supports the magnet, and is attached to the face plate 12 by a few bolts 8. The face plate itself is secured about its periphery to the sidewall, which may be a simple six millimeter thick stainless steel cylinder, by mounting bolts 9, and a cover plate 50 as previously described shields the magnet assembly. Also, the magnet shield plate may be secured between a ring 14B and the lower portion of side wall 14, much as shown in FIGS. 1 and 2.

Figure 5B:
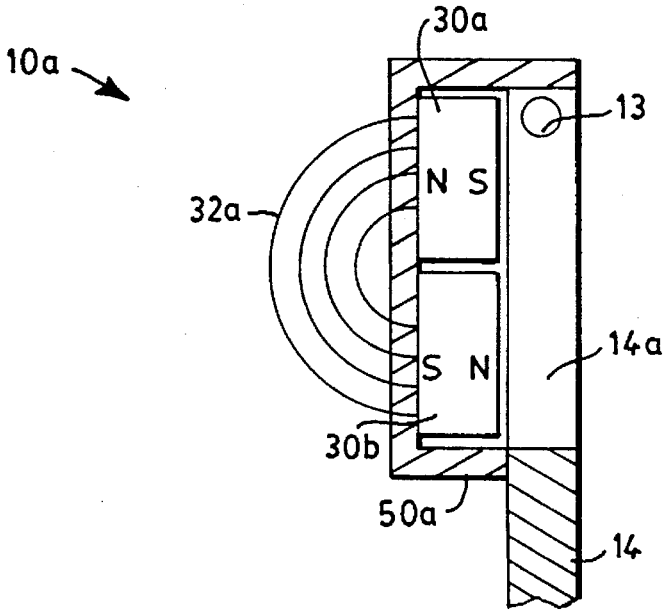

In the embodiment 10*a* shown in FIG. 5B, similar button magnets 30*a*, 30*b* are disposed in two adjacent parallel horizontal rows around the peripheral wall 14. As with the first embodiment, these may be cylindrical magnets which have their north and south poles at the top and bottom of a cylindrical body, and each magnet extends perpendicularly out from the surface on which it rests. For this embodiment, at least the portion of the wall 14*a* supporting the magnets is formed of a magnetic material such as steel, while the remainder of the peripheral wall 14 located away from the magnets may be non-magnetic, e.g. stainless steel, as before. The cover plate 50*a* provides a smooth and closely-fitting U-shaped shield over the ranks of magnets. A chamber face plate 12 (not shown) may extend horizontally over the top surface of the upper rank of magnets so that the field lines 32*a* reside behind an overhanging face that defines a central aperture. Alternatively, in this embodiment, the thick magnet structure extending radially inward may define the central "aperture" region from which positive ions are emitted, without using a further front containing wall.

Figure 5C:
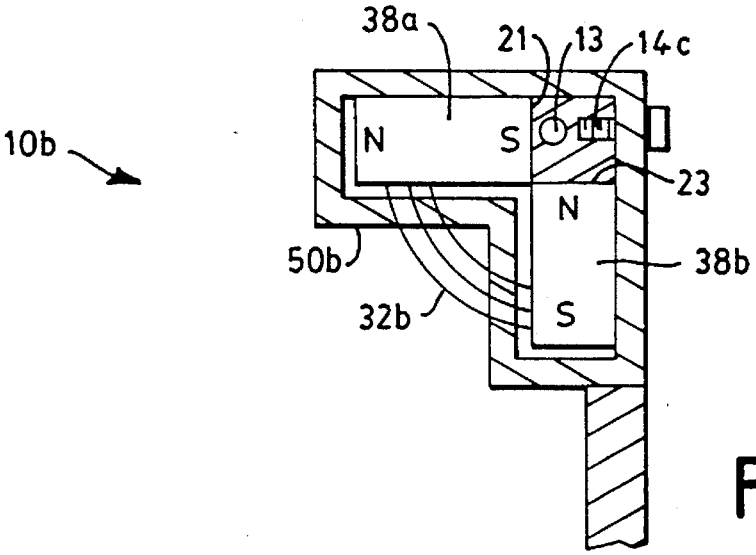

FIG. 5C illustrates the magnet configuration in a third embodiment 10*b* of the invention. In this embodiment rectangular block magnets 38*a*, 38*b* are poled N-S along their length, and are joined in a L-configuration with a different pole of each magnet of a pair contacting one of two adjacent sides 21, 23 of a steel or soft iron ring 14*c* having a square or rectangular cross section. The ring is fitted into or bolted onto the top edge of chamber wall 14, and all magnets of the upper rank of magnets are arranged with like poles (shown with N radially inward), while all vertically-oriented magnets supported on the peripheral wall also have like orientation (shown with S down). The ring 14*c* shunts the proximal opposed poles, so that the distal poles of each magnet pair form a field gap extending between the face and side wall. As shown, field lines 32*b* extend diagonally across this gap. As before, a cover plate 50*b* shields the magnet assembly. By way of scale, rectangular block magnets approximately one centimeter by one centimeter by two to four centimeters long may be arrayed in this L-configuration in a chamber of the previously described dimensions.

In each of the foregoing embodiments, plural pairs of magnets are arranged next to each other, all the way around the circumference, so that the resulting magnetic field lines substantially cover a bounding surface of the peripheral containment band above the peripheral gas introduction region surrounding the central opening.

Figure 4A:
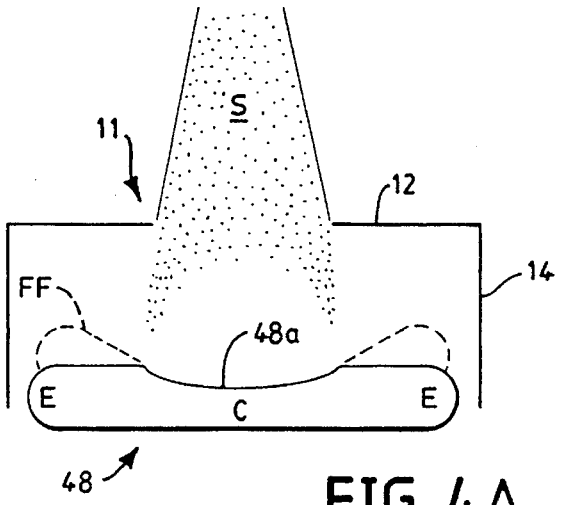
FIGS. 4A–4C illustrate further variations of anode structure.
Figure 4B:
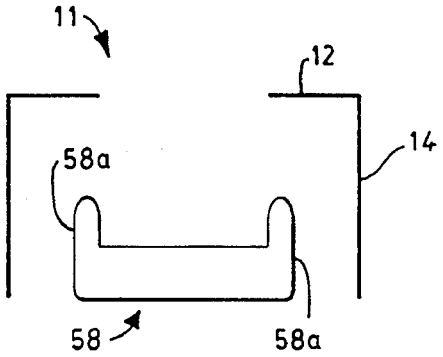
Figure 4C:
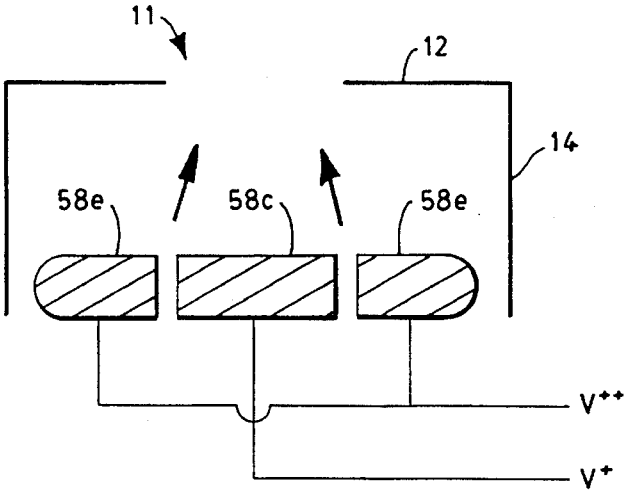

As noted above, the large solid anode 28 or 28' of the embodiments of FIGS. 1 and 2 serves as a baffle to channel incoming gas to a peripheral region where it is directed at the magnetic field lines and effectively ionized, and also serves to expel positively charged ions from the plasma cloud out through the opening 11 as a high current, wide aperture stream. FIGS. 4A–4C show variations in the anode shape of several alternative embodiments of the invention which further advance one or both of these operational functions.

As shown in FIG. 4A, one alternative embodiment of the source includes an anode 48 that has a curved front surface 48*a* which is effective to shape the output beam S and drive it more efficiently through the central opening 11. As noted above, the source overall is arranged as a broad, relatively shallow canister, with a central aperture having a diameter of about sixty percent of the canister diameter, and plasma formation continuously occurring in a narrow peripheral band to supply ions ejected at the center. In the embodiment of FIG. 4A anode 48 has the overall size and optionally cooling features of the previously-described anodes, but has a front surface 48*a* which is contoured to shape the output beam S.

Illustratively, the anode is shown having two general regions, a peripheral portion E lying in the region laterally outside the central opening, and a central portion C lying substantially under the central opening. At least the central portion C is dished or concave to form electric field lines which preferentially impart a motion toward the center of curvature as the anode expels positive ions through the opening. The result is an output beam which is more concentrated and less divergent as it exits the aperture 11. This also reduces edge interception of the beam at the face plate or shield plate. The peripheral portion E is illustrated as flat, but other shapes are within the scope of the invention. For example, the front curvature may extend all or partway to the edge of the anode, as shown by the contour FF illustrated in phantom. This alternative contour gathers ions from a greater area and provides higher field strengths in the peripheral area that effectively drive ions from the active edges of the plasma chamber toward the center.

FIG. 4B illustrates another embodiment 58 of the anode plate. In this embodiment, the anode is substantially coextensive with the central aperture, but has edge walls 58*a* that provide a broad surface area in the plasma-forming peripheral band and also physically channel the gas introduction into this region. The anode is thus cup-shaped, with a front expulsion surface transverse to the source axis A, and a side surface directed radially outward at the peripheral plasma generation containment band. In this embodiment, the front surface may be curved, i.e., dished inwardly to achieve a desired beam shape or specific focal distance, or may bulge convexly out to produce a somewhat divergent output beam.

In any of these expulsion anode embodiments, the curvature is illustrated in a section taken along the beam axis A (FIG. 1), and the source itself may possess a radial symmetry (as described with regard to FIGS. 1, 2 and 3) or may take a form which is cylindrical i.e., forming a segment of fixed cross-sectional shape along a straight line segment transverse to the projection axis (when a wide curtain-shaped beam is desired). Thus, a concave curved anode surface may be watchglass-shaped, or trough-shaped, depending whether on the source shape is configured for a round or a rectangular beam. Furthermore, if greater divergence rather than concentration of the output beam is desired, the central anode may be convex. In this case, other means may be provided to assure that the beam does not excessively intercept the edges of aperture 11.

FIG. 4C shows yet another embodiment of an anode structure 68 for the source of the present invention. In this embodiment, the anode is physically divided into, or formed of two distinct elements, a central plate 58*c* and a peripheral ring 58*e*, each with its own electrical and preferably coolant connections and insulated supports. As before, the central anode is maintained at a positive potential V+. In this embodiment, however, the peripheral anode is maintained at a higher positive potential, denoted V++, greater than that of the central anode. Like the dished or watch glass shape, this again provides a radial electric field gradient to actively drive positive ions toward the central region, where they are expelled by anodic repulsion. It results in a focused or convergent output beam. With the relative magnitudes of the positive potentials on plates 58*c* and 58*e* reversed, a more divergent output beam is produced rather than a convergent one. The latter field configuration may also be used to urge positive ions within the chamber radially outward in order to provide a more uniform distribution of ions throughout the chamber, for example, to eliminate a "hot" spot or band and disperse the ions so they are expelled in a uniform and broad beam throughout the entire cross-section of the aperture 11. Thus, according to this embodiment an anode plate at the back of the chamber is divided into a set of concentric regions which provide a radial field gradient to control ion distribution within the chamber and/or eject a controlled beam shape having a desired degree of focusing or dispersion.

This completes a description of representative embodiments of the invention and details of their construction and implementation. The invention being thus described, further variations and modifications will occur to those skilled in the art, and such variations and modifications are included within the scope of the invention, as defined by the claims appended hereto.

What is claimed is:

1. An ion source having a peripheral wall, a back face and a from face together defining a plasma chamber, an anode plate which channels an ionizable fluid to said chamber adjacent said peripheral wall to diffuse toward said front face, the front face further having a large aperture opening centrally located therein for emitting ions from the chamber, so that said peripheral wall and an annular portion of the front face form a containment band of said plasma chamber ionizing the fluid for emission through said large aperture opening, a source of electrons proximate said opening to provide electrons to the plasma chamber, and a plurality of pairs of magnets disposed around said containment band having magnetic field lines curving into said containment band such that the electrons are trapped in the band and fluid diffusing outward from said peripheral region is efficiently ionized as it travels to the central aperture.

2. An ion source according to claim 1, wherein said anode plate is maintained at a positive potential of between several tens, and several hundred volts to efficiently repel positive ions out through the central aperture.

3. An ion source according to claim 2, wherein the anode plate includes internal passages for circulating a heat exchange fluid therein to control anode temperature.

4. An ion source according to claim 2, further comprising a cover plate of electrically conductive non-magnetic material covering said magnets and defining a smooth continuous inner wall of said plasma chamber.

5. An ion source according to claim 1, wherein said plurality of pairs of magnets are disposed along a surface of said front face oriented inward toward said plasma chamber to define field lines extending outwardly of said surface.

6. An ion source according to claim 1, wherein said plurality of pairs of magnets are adjacent pairs of oppositely oriented magnets disposed along said peripheral wall to define field lines bowing outward from said peripheral wall.

7. An ion source according to claim 1, wherein said plurality of pairs of first and second magnets are adjacent pairs of first and second magnets, the first magnet disposed along the front face and the second magnet disposed along the peripheral wall, the first and second magnets of a pair being shunted together at a corner and forming field lines extending diagonally across said containment band.

8. An ion source according to claim 1, wherein said plurality of pairs of magnets are disposed on a cooled magnetic support for positioning said magnets while cooling the magnets by thermal contact.

9. An ion source comprising a plasma chamber disposed about an axis and having back and side walls and a front face, with an opening centrally located in said front face for emission of ions from the plasma chamber along said axis, means for introducing an ionizable gas about a peripheral region at the back of said plasma chamber, a cathode at the front face for emitting electrons, and a multitude of pairs of permanent magnets disposed on a magnetic support, each magnet having a proximal pole contacting the support and a distal pole not contacting the support, the support shunting proximal poles of adjacent magnets of a pair such that field lines of distal poles of the pair extend through the plasma chamber and trap electrons for effectively ionizing the ionizable gas, said multiplicity of pairs of magnets being arranged so the field lines of all pairs substantially bound a peripheral volume surrounding said central aperture, and an anode for providing power to maintain said plasma and expel positive ions as a flow of ionizable gas is continuously introduced in said peripheral region.

10. An ion source according to claim 9, wherein said anode includes a plate proximate to said back face and extending entirely across said central aperture for defining a central ion-expelling field to expel said positive ions as a defined beam through said opening.

11. An ion source according to claim 10, wherein said anode is a fluid cooled anode.

12. An ion source according to claim 10, wherein said plate includes radially separated regions maintained at different potentials for controlling shape of a beam formed by said positive ions as they are expelled through said central aperture.

13. An ion source comprising a plasma generation chamber including a peripheral wall, a back wall and a front opening cathode means for providing electrons to said plasma generation chamber an anode plate extending centrally across the back wall of said chamber opposite said front opening to provide a positive electric field at said anode plate, magnet means extending circumferentially of said chamber, between the cathode means and the anode plate for trapping electrons within the chamber as the electrons are drawn toward the anode plate, and means for introducing an ionizable fluid into said plasma chamber such that the fluid is ionized by trapped electrons therein and positive ions are expelled from the ionized fluid through said front opening by said anode plate.

14. An ion source according to claim 13, wherein said anode plate includes cooling means for controlling temperature of the anode plate.

15. An ion source according to claim 13, wherein the anode plate has a front surface shaped to provide an electric field which produces an output beam of said expelled positive ions having defined shape.

16. An ion source comprising a plasma generation chamber including a peripheral wall, a back wall and a front opening cathode means for providing electrons to said plasma generation chamber magnet means for trapping electrons within said plasma generation chamber an anode plate extending across the back wall of said chamber opposite said front opening to provide a positive electric field at said anode plate, and means for introducing an ionizable fluid into said plasma chamber such that the fluid is ionized therein and positive ions are expelled from the ionized fluid through said front opening by said anode plate wherein the anode plate is formed of plural separate parts, the parts being maintained at different potentials for directing ions inwardly to a central region of said chamber and repelling the ions so directed forwardly through said opening.

17. An ion source according to claim 13, wherein the anode plate channels the fluid introduced by the introducing means into a peripheral portion of said chamber to be ionized.

18. An ion source for producing ions directed along a first axis, said ion source having a plasma chamber with a front wall spaced along said axis from a back wall and a peripheral wall extending between said front and back walls and with said front wall being apertured with an opening for the passage of particles, including the passage of ions axially outward from said chamber, said source further comprising a) an annular chamber-containment portion formed within the chamber by said front wall and by said peripheral wall and located substantially concentric with said axis and circumferentially outward from the front wall opening, b) means forming a fluid inlet for introducing an ionizable fluid into said chamber proximate said chamber-containment portion, c) an anode within said chamber and extending at least partially outside said chamber-containment portion and arranged for receiving an electric potential for expelling ions along said axis and outward from said chamber, and d) a magnet having pole faces disposed in an annulus relative to, and adjacent with, said chamber-containment portion for producing magnetic field lines within said chamber-containment portion to trap electrons therein for exposure to and interaction with the ionizable fluid introduced to said chamber by way of said inlet means and effectively produce ions for expulsion through said opening.

19. An ion source according to claim 18, wherein the anode is entirely outside the chamber-containment portion and extends opposite the central aperture.

20. An ion source according to claim 18, wherein the anode is maintained at a potential difference much greater than the ionization voltage of said fluid.

* * * * *